US008600273B2

(12) United States Patent
Yamada et al.

(10) Patent No.: US 8,600,273 B2
(45) Date of Patent: Dec. 3, 2013

(54) DEVELOPING ROLLER, PROCESS CARTRIDGE, AND ELECTROPHOTOGRAPHIC APPARATUS

(75) Inventors: Masaki Yamada, Mishima (JP); Takashi Kusaba, Suntou-gun (JP); Kunimasa Kawamura, Mishima (JP); Yuji Sakurai, Susono (JP); Toru Ishii, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/438,580

(22) Filed: Apr. 3, 2012

(65) Prior Publication Data

US 2012/0195631 A1 Aug. 2, 2012

Related U.S. Application Data

(63) Continuation of application No. PCT/JP2011/007035, filed on Dec. 16, 2011.

(30) Foreign Application Priority Data

Dec. 28, 2010 (JP) ..... 2010-292765

(51) Int. Cl.
*G03G 15/08* (2006.01)

(52) U.S. Cl.
USPC ..... 399/286; 29/895; 399/279; 492/53

(58) Field of Classification Search
USPC ..... 399/286, 279, 265; 492/18, 49, 53, 56; 29/895
See application file for complete search history.

(56) References Cited

U.S. PATENT DOCUMENTS 6,586,149 B2 7/2003 Kawamura et al.
6,600,893 B2 7/2003 Ashibe et al.

(Continued)

FOREIGN PATENT DOCUMENTS

JP 57-5047 A 1/1982
JP 7-199645 A 8/1995

(Continued)

OTHER PUBLICATIONS

PCT International Search Report and Written Opinion of the International Searching Authority, International Application No. PCT/JP2011/007035, Mailing Date Feb. 7, 2012.

(Continued)

*Primary Examiner* — Sophia S Chen
(74) *Attorney, Agent, or Firm* — Fitzpatrick, Cella, Harper and Scinto

(57) ABSTRACT

A developing roller including a mandrel, an elastic layer provided on the mandrel and containing a cured material of an addition curable-type dimethyl silicone rubber, and a surface layer containing a urethane resin that covers the circumferential surface of the elastic layer. The urethane resin has a structure represented by the following formula (1), and one or both structures selected from a structure represented by the following formula (2) and a structure represented by the following formula (3) between two adjacent urethane linkages.

formula (1)

formula (2)

formula (3)

4 Claims, 5 Drawing Sheets

(56) References Cited

U.S. PATENT DOCUMENTS

| | | | |
|---|---|---|---|
| 6,636,715 | B2 | 10/2003 | Kawamura et al. |
| 6,725,002 | B2 | 4/2004 | Sakurai et al. |
| 6,737,133 | B2 | 5/2004 | Kusaba et al. |
| 7,060,406 | B2 | 6/2006 | Kawamura et al. |
| 7,201,967 | B2 | 4/2007 | Sakurai et al. |
| 7,208,211 | B2 | 4/2007 | Tanaka et al. |
| 7,727,134 | B2 | 6/2010 | Nakamura et al. |
| 7,797,833 | B2 | 9/2010 | Nakamura et al. |
| 7,798,948 | B2 | 9/2010 | Kawamura et al. |
| 7,799,398 | B2 | 9/2010 | Nakamura et al. |
| 7,979,004 | B2 | 7/2011 | Tanaka et al. |
| 8,176,632 | B2 | 5/2012 | Kawamura et al. |
| 2012/0091608 | A1 | 4/2012 | Kawamura et al. |
| 2012/0195649 | A1 | 8/2012 | Kawamura et al. |

FOREIGN PATENT DOCUMENTS

| | | | |
|---|---|---|---|
| JP | 2005-141192 | A | 6/2005 |
| JP | 2006-251342 | A | 9/2006 |
| JP | 2007-133113 | A | 5/2007 |
| JP | 2007-156435 | A | 6/2007 |
| JP | 2008-164915 | A | 7/2008 |

OTHER PUBLICATIONS

Ishii, et al., U.S. Appl. No. 13/526,457, filed Jun. 18, 2012.

International Preliminary Report on Patentability, International Application No. PCT/JP2011/007035, Mailing Date Jul. 11, 2013.

DEVELOPING ROLLER, PROCESS CARTRIDGE, AND ELECTROPHOTOGRAPHIC APPARATUS

CROSS-REFERENCE TO RELATED APPLICATIONS

This application is a continuation of International Application No. PCT/JP2011/007035, filed Dec. 16, 2011, which claims the benefit of Japanese Patent Application No. 2010-292765, filed Dec. 28, 2010.

BACKGROUND OF THE INVENTION

1. Field of the Invention

The present invention relates to a developing roller used for an electrophotographic apparatus, a process cartridge having the developing roller, and an electrophotographic apparatus.

2. Description of the Related Art

In electrophotographic apparatuses (such as copiers, fax machines, and printers using electrophotography), an electrophotographic photosensitive member (hereinafter, also referred to as a "photosensitive member") is charged by a charging unit, and exposed by a laser or the like to form an electrostatic latent image on the photosensitive member. Next, a toner in a developing container is applied onto a developing roller by a toner feeding roller and a toner controlling member. By the toner conveyed by the developing roller to a region to be developed, an electrostatic latent image on the photosensitive member is developed in a contact portion between the photosensitive member and the developing roller or a portion in the vicinity thereof. Subsequently, the toner on the photosensitive member is transferred onto a recording paper by a transferring unit, and fixed by heat and pressure. The remaining toner on the photosensitive member is removed by a cleaning blade.

As the developing roller, an elastic roller having an electric resistance of $10^3$ to $10^{10}$ Ω·cm is usually used. Moreover, in consideration of a demand for higher durability of the developing roller and higher quality of the electrophotographic image, a developing roller provided with a surface layer on the surface of the elastic layer is used.

Here, as the elastic layer of the developing roller, silicone rubbers having high deformation recoverability and flexibility are suitably used. As the surface layer, polyurethanes having high resistance to wear and toner charging properties are used.

Japanese Patent Application Laid-Open No. 2005-141192 discloses a method in which a poly (tetramethylene glycol) polyurethane surface layer comprising a specific composition is provided on a silicone rubber elastic layer to suppress problems under various environments of temperature and humidity. Japanese Patent Application Laid-Open No. 2006-251342 discloses a composition of a polyether polyurethane surface layer that can suppress fusing of a low melting point toner.

Further, Japanese Patent Application Laid-Open No. H07-199645 discloses a developing roller using a polyurethane surface layer having a low water absorption rate in order to keep charging properties under a high temperature and high humidity environment.

SUMMARY OF THE INVENTION

Recently, in the electrophotographic apparatus, it has been demanded that high quality of an image and durability can be kept even under a severer environment. While silicone rubbers have high physical properties as a constituent material for the elastic layer as described above, these are a material having a low polarity. For this reason, according to examination by the present inventors, in the case where the developing rollers according to Japanese Patent Application Laid-Open No. 2005-141192, Japanese Patent Application Laid-Open No. 2006-251342, and Japanese Patent Application Laid-Open No. H07-199645 including the elastic layer containing a silicone rubber are left for a long period of time under a high temperature and highly humid environment wherein the temperature is 40° C. and a relative humidity is 95%, the surface layer was peeled off from the silicone rubber elastic layer in some cases. Moreover, in the developing rollers according to Japanese Patent Application Laid-Open No. 2005-141192, Japanese Patent Application Laid-Open No. 2006-251342, and Japanese Patent Application Laid-Open No. H07-199645, the toner strongly adheres to the surface thereof, and unevenness in the concentration attributed to the adhering object of the toner are caused in the electrophotographic image in some cases.

The present invention is directed to providing a developing roller used for formation of an electrophotographic image with high quality in which peel-off of a surface layer from an elastic layer is suppressed in storage and use under a high temperature and highly humid environment, and a toner is difficult to adhere onto the surface of the developing roller.

Further, the present invention is directed to providing an electrophotographic image forming apparatus that can stably output an electrophotographic image with high quality, and a process cartridge used for the electrophotographic image forming apparatus.

In order to achieve the objects, the present inventors made extensive research. As a result, it was found out that a surface layer including a polyurethane resin having a specific structure has high adhesiveness to a silicone rubber elastic layer, and a toner is difficult to adhere to the surface of the surface layer. Thus, the present invention has been made.

Namely, according to one aspect of the present invention, there is provided a developing roller including a mandrel, an elastic layer, and a surface layer that covers the surface of the elastic layer, wherein the elastic layer contains a cured material of an addition curable-type dimethyl silicone rubber, the surface layer contains a urethane resin, and the urethane resin has, between two adjacent urethane, a structure represented by the following formula (1), and at least one structure selected from the group consisting of a structure represented by the following formula (2) and a structure represented by the following formula (3):

formula (1)

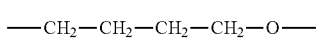

formula (2)

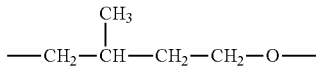

formula (3)

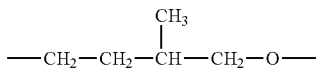

Moreover, according to another aspect of the present invention, there is provided a process cartridge including at least a developing roller mounted thereon, and being detachably attached to an electrophotographic apparatus, wherein the developing roller mounted on the process cartridge is the developing roller described above.

According to a yet another aspect of the present invention, there is provided an electrophotographic apparatus including a developing roller, and an electrophotographic photosensitive member disposed abutting on the developing roller.

According to the present invention, a surface layer including a urethane resin having a specific structure unit is provided, on an elastic layer containing a cured material of an addition curable-type dimethyl silicone rubber. Thereby, there can be obtained a developing roller used for formation of an electrophotographic image with high quality in which both peel-off of the surface layer and adhesion of the toner can be suppressed at a high level even in the case of long-term storage under a high temperature and high humidity environment.

Moreover, according to the present invention, there can be obtained a process cartridge and electrophotographic apparatus that can stably form an electrophotographic image with high quality.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
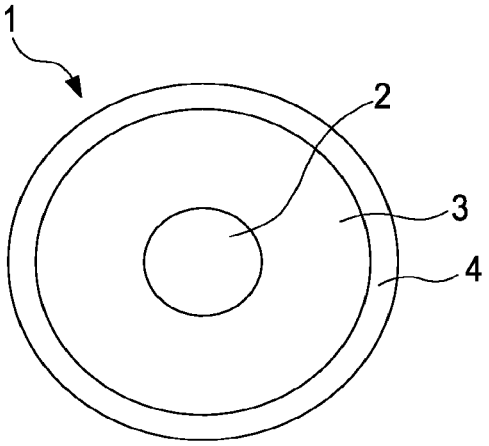
FIG. 1 is a conceptual drawing illustrating an example of a developing roller according to the present invention.

One embodiment of the developing roller 1 according to the present invention is illustrated in FIG. 1. In the developing roller 1 illustrated in FIG. 1, an elastic layer 3 is formed on an outer peripheral surface of a cylindrical or hollow cylindrical conductive mandrel 2. The outer peripheral surface of the elastic layer 3 is covered with a surface layer 4.

<Mandrel>

The mandrel 2 functions as an electrode and a supporting member for the developing roller 1. The mandrel 2 is formed with a metal or alloy such as aluminum, copper alloys, and stainless steel; chromium or nickel-plated iron; or an electrically conductive material such as synthetic resins having electrical conductivity.

<Elastic Layer>

The elastic layer 3 gives the developing roller elasticity needed to form a nip having a predetermined width in an abutting portion between the developing roller and the photosensitive member. The elastic layer 3 contains a cured material of an addition curable-type dimethyl silicone rubber that gives high deformation recoverability from deformation and flexibility to the elastic layer.

In order to strengthen adhesion between the surface layer and the elastic layer by hydrophobic interaction, it is thought that the amount of water molecules to exist in the vicinity of the adhering interface is smaller. In the silicone rubber, the rubber component itself has low polarity, and has low water absorbing properties. For this reason, depending on the kind of a filler to be contained, the water absorption rate of the elastic layer can be lowered to an extremely low level. Thereby, a high adhesion effect between the elastic layer and the surface layer containing a urethane resin by the hydrophobic interaction, which will be described later, can be further improved.

Specifically, the elastic layer 3 has a water absorption rate of preferably not more than 0.10%, and more preferably not less than 0.02% and not more than 0.10% according to Japanese Industrial Standard (JIS) K7209 Method A.

Examples of the addition curable-type dimethyl silicone rubber include: polydimethylsiloxane, polymethylvinylsiloxane, polyphenylvinylsiloxane, polymethoxymethylsiloxane, polyethoxymethylsiloxane, and copolymers of these polysiloxanes.

The elastic layer 3 can contain conductive fine particles. As the conductive fine particles, carbon black or conductive metals such as aluminum and copper; and fine particles of conductive metal oxides such as zinc oxide, tin oxide, and titanium oxide can be used. Particularly preferred is carbon black because high electrical conductivity can be obtained by a relatively small amount of carbon black to be added.

In order to lower the water absorption rate of the elastic layer 3, preferred is use of those particularly having low affinity for water among the conductive fine particles. For example, in the case where carbon black is used as the conductive particles, preferably, carbon black having a relatively large primary particle size and the surface not subjected to polarization is selected. Specifically, in consideration of reinforceability and electrical conductivity of the rubber, suitably used carbon black is those having the primary particle size in the range of not less than 30 nm and not more than 60 nm, and having the surface neutralized or hydrophobized, namely, the pH value of not less than 5.0 and not more than 8.0 as the surface properties.

In the case where carbon black as above is used as the conductive fine particles, the content thereof as the guideline is 5 to 20 parts by mass based on 100 parts by mass of the silicone rubber in the elastic layer.

In the case where conductive fine particles other than carbon black are used, the amount of the fine particles to be added is preferably adjusted according to the moisture absorbing properties of the fine particles such that the water absorption rate of the elastic layer falls within the range above.

The elastic layer 3 may properly contain a variety of additives such as a non-conductive filler, a crosslinking agent, and a catalyst other than the conductive fine particles.

<Surface Layer>

The urethane resin contained in the surface layer 4 has a structure represented by the following formula (1) and one or both of structures selected from the group consisting of a structure represented by the following formula (2) and a structure represented by the following formula (3) between adjacent urethane linkages. Namely, the urethane resin according to the present invention has a structure in the molecule in which the structure represented by the following formula (1) and one or both of structures selected from the group consisting of the structure represented by the following formula (2) and the structure represented by the following formula (3) are interposed between two urethane linkages.

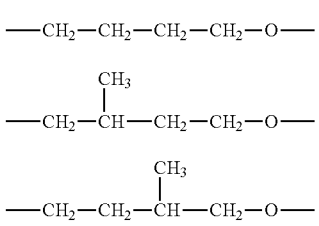

formula (1)

formula (2)

formula (3)

Figure 5:
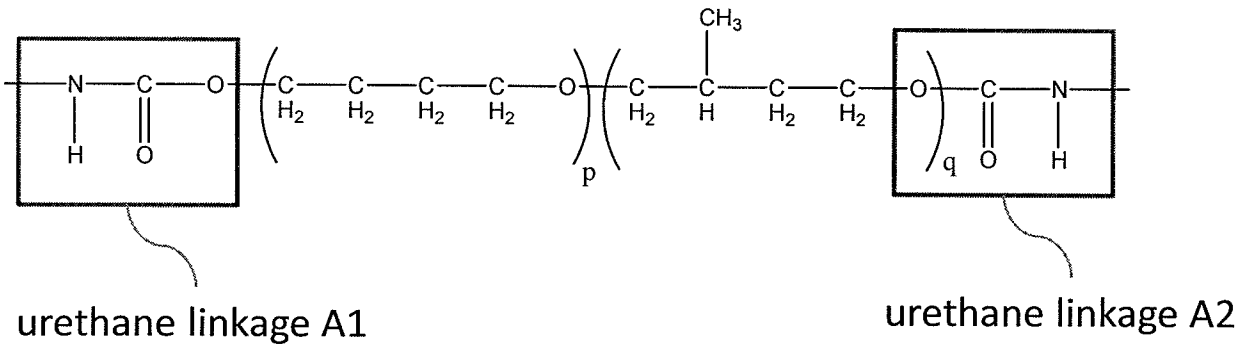
FIG. 5 is a drawing illustrating a characteristic structure that a urethane resin according to the present invention has.
Figure 6:
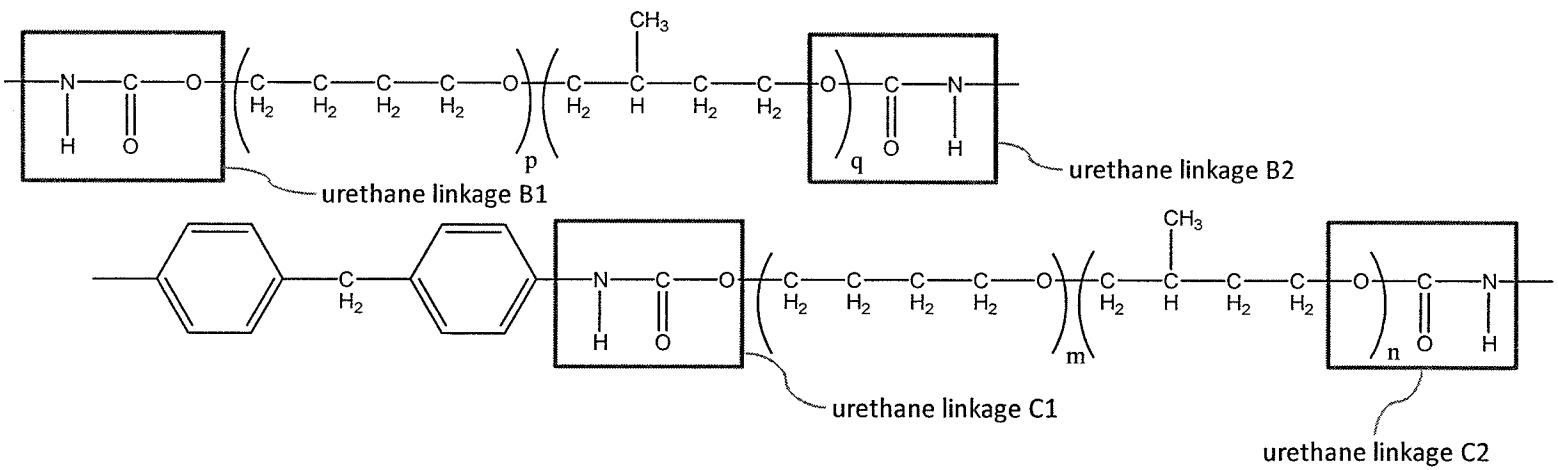
FIG. 6 is a drawing illustrating a characteristic structure that a urethane resin according to the present invention has.

FIG. 5 and FIG. 6 illustrate part of a characteristic structure that the urethane resin according to the present invention has. In FIG. 5, the structure represented by the formula (1) and the structure represented by the formula (2) are interposed between adjacent urethane linkages A1 and A2. In the urethane resin illustrated in FIG. 6, the structure represented by the formula (1) and the structure represented by the formula (2) are interposed between adjacent urethane linkages B1 and B2, and between adjacent urethane linkages C1 and C2. Usually, adhesiveness of synthetic resins mainly depends on interaction of a polarity functional group such as hydrogen bonding and acid-base interaction, in addition to chemical bonding. However, the silicone rubber has extremely low polarity, and the surface thereof is inactive. For this reason, usually, strong interaction by a polarity functional group cannot be expected in the adhesiveness between the elastic layer containing a silicone rubber and the surface layer containing a polyurethane resin. The elastic layer and the surface layer according to the present invention, however, demonstrate high adhesiveness even in the case where these are left for a long period of time under a high temperature and highly humid severe environment.

Although the detailed reason is being examined, the present inventors presume as follows.

Namely, the urethane resin having the structure represented by the formula (1) and at least one structure selected from the group consisting of the structure represented by the formula (2) and the structure represented by the formula (3) that exist between adjacent urethane linkages has an extremely lower polarity as polyurethane than that in the conventional polyether polyurethane because a methyl group is introduced into the side chain. On the other hand, it is known that the cured material of the addition curable-type dimethyl silicone rubber has a "spiral" molecular structure in which six siloxane (Si—O) bonds rotate once, and a methyl group is oriented outward. Namely, the surface of the polymer chain of the silicone rubber is substantially covered with a hydrophobic methyl group. For this reason, an attraction that acts between hydrophobic molecules acts between the methyl group on the surface of the silicone rubber in the elastic layer according to the present invention and the methyl group as the side chain, which is introduced between the two adjacent urethane linkages in the urethane resin of the surface layer. As a result, it is thought that the surface layer and the elastic layer according to the present invention demonstrate high adhesiveness.

Moreover, the polyurethane according to the present invention contains a polyether component represented by the formula (1), and has high flexibility. Because the polyurethane according to the present invention contains one or both of structures selected from the group consisting of the structure represented by the formula (2) and the structure represented by the formula (3), crystallinity in the range of a low temperature is remarkably reduced. For this reason, the developing roller including the surface layer containing the polyurethane according to the present invention is flexible even under a low temperature environment, and the hardness of the developing roller is difficult to increase. Accordingly, even under a low temperature environment, stress given to the toner is smaller, and filming hardly occurs.

Moreover, the polyurethane according to the present invention has the structure represented by the formula (2) or (3) having higher hydrophobicity than that in the structure represented by the formula (1) within the molecule. For this reason, affinity of the urethane resin itself for water is reduced, and a relatively lower water absorbing properties as the urethane resin can be obtained. Further, in the range of a high temperature, mobility of the molecules in the range of a high temperature is suppressed by the presence of the methyl group as the side chain in the structure represented by the formula (2) or (3). For this reason, the stickiness of the surface of the developing roller according to the present invention is difficult to increase even under a high temperature and highly humid environment, and adhesion of the toner to the surface of the developing roller under a high temperature and highly humid environment can be effectively suppressed.

As the urethane resin according to the present invention, preferred are those obtained by random copolymerization of the structure represented by the formula (1) with at least one selected from the group consisting of the structures represented by the formula (2) and the formula (3). This is because the effect of reducing the crystallinity in the range of a low temperature and the effect of suppressing mobility of the molecules in the range of a high temperature are higher.

In the polyurethane, "molar ratio of the structure represented by the formula (1)": "molar ratio of at least one structure selected from the structures represented by the formulas (2) and (3)" is preferably 80:20 to 50:50. If the molar ratios of the structures represented by the respective formulas are in the range, adhering properties of the toner to the surface and peel-off of the surface layer are more effectively suppressed. Moreover, flexibility in the range of a low temperature is high, and durability is also high.

Preferably, the polyurethane contained in the surface layer is obtained by thermally curing a polyether diol having the structure represented by the formula (1) and at least one structure selected from the structures represented by the formulas (2) and (3) or a hydroxyl group-terminated prepolymer prepared by reacting the polyether diol with aromatic diisocyanate, and an isocyanate group-terminated prepolymer prepared by reacting the polyether diol with aromatic isocyanate.

Usually, the following method is used for synthesis of polyurethane:

(1) a one-shot method in which a polyol component is mixed with and reacted with an polyisocyanate component, and (2) a method in which an isocyanate group-terminated prepolymer obtained by reacting part of polyol with isocyanate is reacted with a chain extender such as low molecular weight diol and low molecular weight triol.

However, the polyether diol having the structure represented by the formula (1) and at least one structure selected from the structures represented by the formulas (2) and (3) is a material having low polarity. For this reason, the polyether diol has small compatibility with isocyanate having high polarity, and phases are easily separated into a portion having a high ratio of polyol and a portion having a high ratio of isocyanate in the system microscopically. In the portion having a high ratio of polyol, the non-reacted component is likely to remain, and exudation of the remaining non-reacted polyol may cause the toner to adhere to the surface of the developing roller.

In order to reduce the remaining non-reacted polyol, isocyanate having high polarity needs to be excessively used. As a result, the water absorption rate of polyurethane is often higher. In the methods above, isocyanates are often reacted with each other in a higher percentage, leading to production of urea linkages and allophanate linkages having high polarity.

The polyether diol having the structure represented by the formula (1) and at least one structure selected from the structures represented by the formulas (2) and (3) or the hydroxyl group-terminated prepolymer prepared by reacting the polyether diol with aromatic diisocyanate and the isocyanate group-terminated prepolymer prepared by reacting the polyether diol with aromatic isocyanate are thermally cured. Thereby, the difference in polarity between polyol and isocyanate can be reduced. For this reason, the compatibility of polyol with isocyanate is improved, and a polyurethane having a lower polarity can be obtained in a smaller ratio of isocyanate than in the conventional example. Further, because the remaining non-reacted polyol can be reduced significantly, the toner adhering to the surface of the developing roller due to exudation of the non-reacted polyol can be suppressed.

In the case of using the hydroxyl group-terminated prepolymer prepared by reacting the polyether diol including the structure represented by the formula (1) and the structure represented by the formula (2) or (3) with aromatic diisocyanate, the number average molecular weight of the prepolymer is preferably not less than 10000 and not more than 15000.

In the case of using the isocyanate group-terminated prepolymer, the content of isocyanate in the prepolymer is preferably in the range of 3.0% by mass to 4.0% by mass. If the molecular weight of the hydroxyl group-terminated prepolymer and the content of isocyanate in the isocyanate group-terminated prepolymer are in the ranges, reduction in the water absorption rate of the polyurethane to be produced and suppression of the remaining non-reacted component are well balanced, and the effect of suppressing the adhering toner and peel-off of the surface layer can be compatible at a higher level.

More preferably, the polyurethane according to the present invention is obtained by thermally curing the (a) hydroxyl group-terminated prepolymer described below and the (b) isocyanate group-terminated prepolymer described below.

(a) hydroxyl group-terminated prepolymer prepared by reacting polyether diol having the structure represented by the formula (1) and at least one structure selected from the structures represented by the formulas (2) and (3) and the number average molecular weight of not less than 2000 and not more than 3000 with aromatic diisocyanate, and having the number average molecular weight of not less than 10000 and not more than 15000

(b) isocyanate group-terminated prepolymer prepared by reacting polyether diol having the structure represented by the formula (1) and at least one structure selected from the structures represented by the formulas (2) and (3) and the number average molecular weight of not less than 2000 and not more than 3000 with aromatic isocyanate If the polyether diol having the number average molecular weight of not less than 2000 and not more than 3000 is used as a raw material for the hydroxyl group-terminated prepolymer and the isocyanate group-terminated prepolymer, the water absorption rate of the polyurethane to be finally obtained can be reduced, and the remaining non-reacted component can be suppressed. Further, because strength and stickiness of the surface layer are high, durability can also be improved.

Between two urethane linkages, when necessary, polypropylene glycol and aliphatic polyester may be contained other than the structure represented by the formula (1) and at least one structure selected from the structures represented by the formulas (2) and (3) at an extent that the effect of the present invention is not impaired. Examples of aliphatic polyester include aliphatic polyester polyols obtained by condensation reaction of a diol component such as 1,4-butanediol, 3-methyl-1,5-pentanediol, neopentyl glycol or a triol component such as trimethylolpropane with a dicarboxylic acid such as adipic acid, glutaric acid, and sebacic acid.

These polyol components may be a prepolymer in which the chain is extended in advance by isocyanate such as 2,4-tolylenediisocyanate (TDI), 1,4-diphenylmethanediisocyanate and isophorone diisocyanate (IPDI), when necessary.

Preferably, the content of the component having structure other than the structure represented by the formula (1) and at least one structure selected from the structures represented by the formulas (2) and (3) is not more than 20% by mass in the polyurethane from the viewpoint of demonstrating the effect of the present invention.

The isocyanate compound to be reacted with these polyol components is not particularly limited. Aliphatic polyisocyanates such as ethylene diisocyanate and 1,6-hexamethylene diisocyanate (HDI); alicyclic polyisocyanates such as isophorone diisocyanate (IPDI), cyclohexane-1,3-diisocyanate, and cyclohexane-1,4-diisocyanate; aromatic isocyanates such as 2,4-tolylenediisocyanate, 2,6-tolylenediisocyanate (TDI), 4,4'-diphenylmethane diisocyanate (MDI), polymeric diphenylmethane diisocyanate, xylylene diisocyanate, and naphthalene diisocyanate; and copolymerized products, isocyanurates, TMP adducts, and biurets thereof, and block copolymers can be used.

Among these, aromatic isocyanates such as tolylene diisocyanate, diphenylmethane diisocyanate, and polymeric diphenylmethane diisocyanate are more suitably used.

The polyurethane obtained by reacting aromatic isocyanate with the polyether component having the structure represented by the formula (1) and at least one structure selected from the structures represented by the formulas (2) and (3) between the urethane linkages is preferred because the polyurethane has high softness and strength and low stickiness under a high temperature and high humidity.

As the ratio of the isocyanate compound to be mixed with the polyol component, the ratio of the isocyanate group is preferably in the range of 1.2 to 4.0 based on 1.0 of the hydroxyl group in polyol.

Preferably, the surface layer 4 has electrical conductivity. Examples of an electrical conductivity-imparting unit include addition of an ion conductive agent and conductive fine particles. The conductive fine particles that are inexpensive and have small fluctuation of resistance by an environment are suitably used. From the viewpoint of electrical conductivity-imparting abilities and reinforceability, carbon black is particularly preferred. As the properties of the conductive fine particles, the primary particle size is not less than 18 nm and not more than 50 nm, and the DBP absorption number is not less than 50 ml/100 g and not more than 160 ml/100 g. Use of such carbon black is preferred, and the balance among electrical conductivity, hardness, and dispersibility is good. The content of the conductive fine particles is preferably not less than 10% by mass and not more than 30% by mass based on 100 parts by mass of a resin component that forms the surface layer.

In the case where the developing roller needs surface roughness, fine particles for controlling the surface roughness may be added to the surface layer 4. The fine particles for controlling the surface roughness preferably have a volume average particle size of 3 to 20 μm. Preferably, the amount of the particle to be added to the surface layer is 1 to 50 parts by mass based on 100 parts by mass of the resin solid content in the surface layer. As the fine particles for controlling the surface roughness, fine particles such as polyurethane resins, polyester resins, polyether resins, polyamide resins, acrylic resins, and phenol resins can be used.

The method for forming the surface layer 4 is not particularly limited, and examples thereof include spray, dipping, or roll coating using a coating material. In dip coating, a method as described in Japanese Patent Application Laid-Open No. S57-005047, in which a coating material is overflowed from the upper end of a dipping bath, is simple and has excellent production stability as the method for forming the surface layer.

Figure 4:
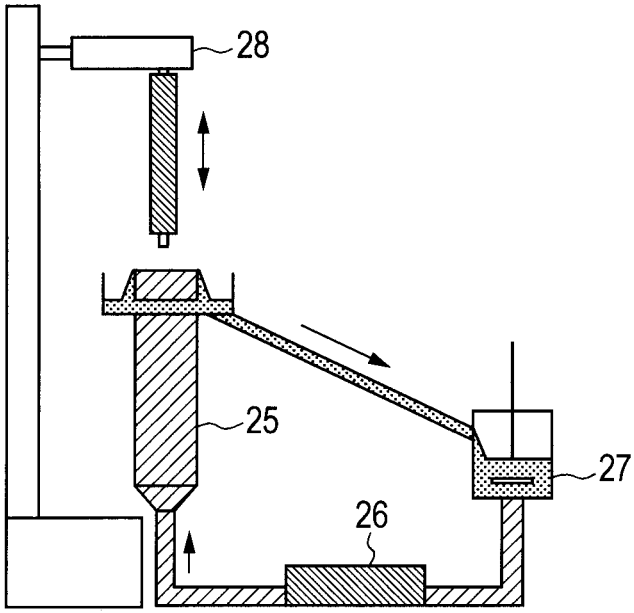
FIG. 4 is a conceptual drawing illustrating an example of a liquid circulating dip coater.

FIG. 4 is a schematic view of a dip coater. A cylindrical dipping bath 25 has an inner diameter slightly larger than the outer diameter of the developing roller, and a depth larger than the length in the axis direction of the developing roller. An annular liquid receiving portion is provided in an outer periphery of the upper end of the dipping bath 25, and connected to a stirring tank 27. The bottom of the dipping bath 25 is connected to the stirring tank 27. A coating material in the stirring tank 27 is fed by a liquid feeding pump 26 to the bottom of the dipping bath 25. The coating material is overflowed from the upper end of the dipping bath, and returned to the stirring tank 27 via the liquid receiving portion on the outer periphery of the upper end of the dipping bath 25. The mandrel 2 provided with the elastic layer 3 is vertically fixed to a hoisting and lowering apparatus 28, dipped into the dipping bath 25, and lifted up to form the surface layer 4.

The developing roller according to the present invention can be used for non-contact developing apparatuses and contact developing apparatuses using a magnetic one-component developer and a non-magnetic one-component developer, and developing apparatuses using a two-component developer.

Figure 2:
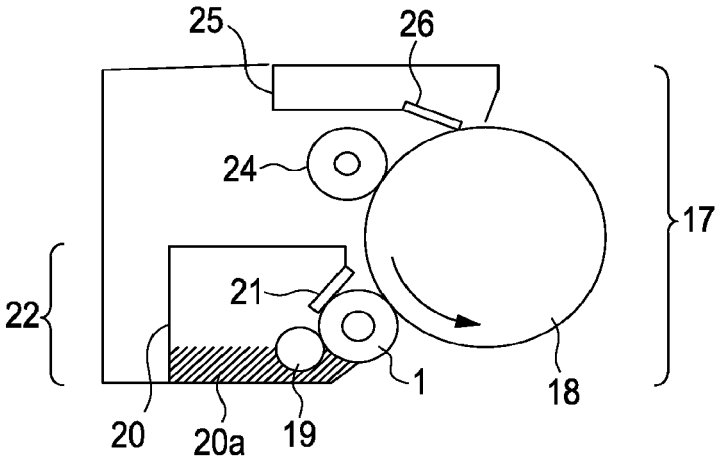
FIG. 2 is a schematic configuration diagram illustrating an example of a process cartridge according to the present invention.

FIG. 2 is a sectional view of a process cartridge according to the present invention. The process cartridge illustrated in FIG. 2 includes the developing roller 1, a developing blade 21, a developing apparatus 22, an electrophotographic photosensitive member 18, a cleaning blade 26, a waste toner accommodating container 25, and a charging roller 24, which are integrated into one and detachably attached to the main body of an electrophotographic image forming apparatus. The developing apparatus 22 includes a toner container 20. The toner container 20 is filled with a toner 20*a*. The toner 20*a* in the toner container 20 is fed by a toner feeding roller 19 to the surface of the developing roller 1, and a layer of the toner 20*a* having a predetermined thickness is formed on the surface of the developing roller 1 by the developing blade 21.

Figure 3:
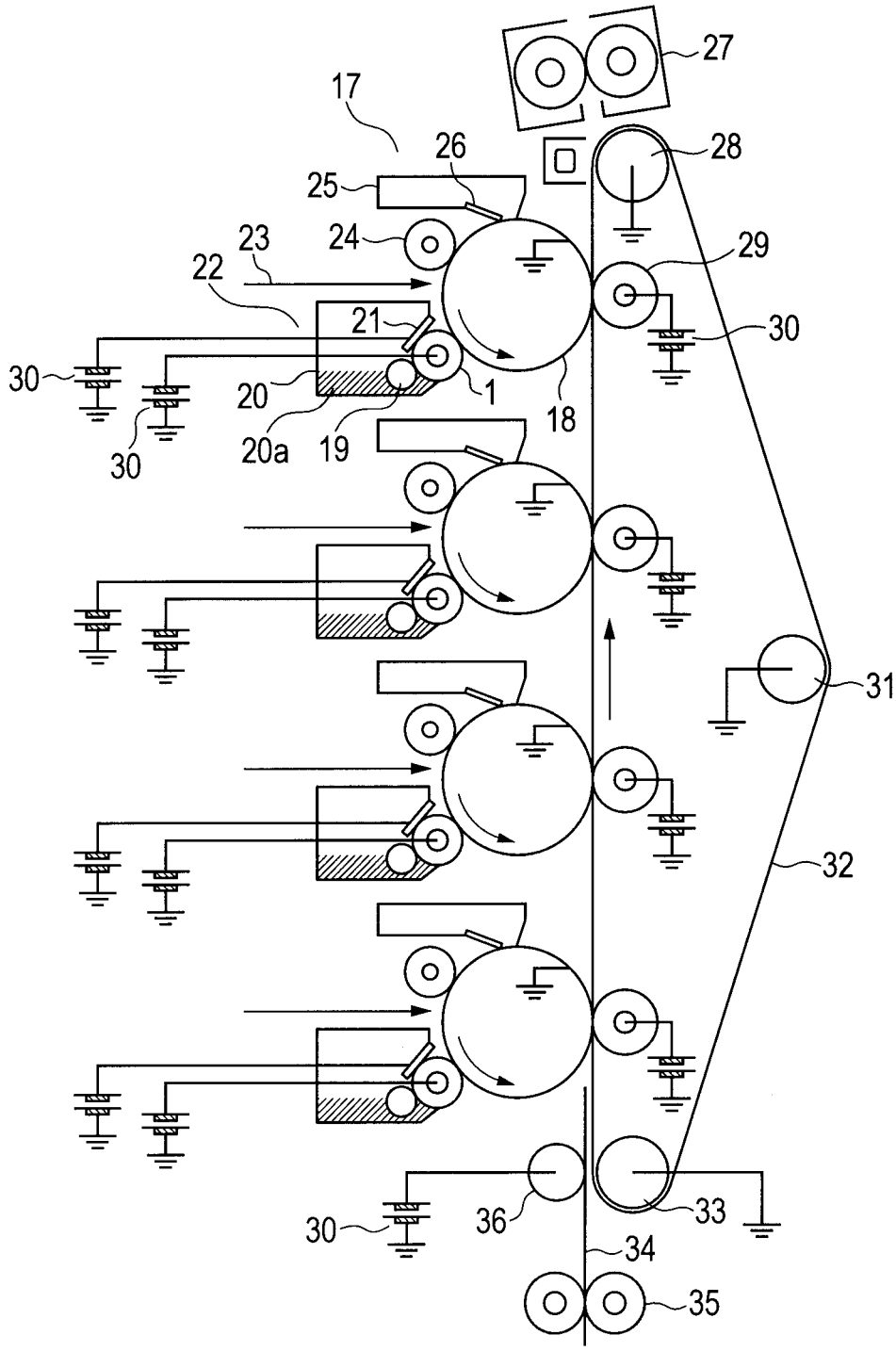
FIG. 3 is a schematic configuration diagram illustrating an example of an electrophotographic apparatus according to the present invention.

FIG. 3 is a sectional view of an electrophotographic apparatus using the developing roller according to the present invention. The developing apparatus 22 including the developing roller 1, the toner feeding roller 19, the toner container 20, and the developing blade 21 is detachably attached to the electrophotographic apparatus in FIG. 3. Moreover, a process cartridge 17 including the photosensitive member 18, the cleaning blade 26, the waste toner accommodating container 25, and the charging roller 24 is detachably attached. Alternatively, the photosensitive member 18, the cleaning blade 26, the waste toner accommodating container 25, and the charging roller 24 may be provided in the main body of the electrophotographic apparatus. The photosensitive member 18 rotates in the arrow direction, and is uniformly charged by the charging roller 24 for charging the photosensitive member 18. An electrostatic latent image is formed on the surface of the photosensitive member 18 by laser light 23 from an exposing unit for writing an electrostatic latent image on the photosensitive member 18. The toner 20*a* is supplied to the electrostatic latent image by the developing apparatus 22 disposed in contact with the photosensitive member 18 to develop the electrostatic latent image. Thereby, the electrostatic latent image is visualized as a toner image.

The so-called reversal development in which the toner image is formed in an exposed portion is performed. The visualized toner image on the photosensitive member 18 is transferred onto a paper 34 as a recording medium by a transfer roller 29 as a transfer member. The paper 34 is passed through a paper feed roller 35 and an adsorbing roller 36, fed into the apparatus, and conveyed between the photosensitive member 18 and the transfer roller 29 by an endless belt-shaped transfer conveyer belt 32. The transfer conveyer belt 32 is driven by a following roller 33, a driving roller 28, and a tension roller 31. A voltage is applied to the transfer roller 29 and the adsorbing roller 36 from a bias power supply 30. The paper 34 having a transferred toner image is fixed by a fixing apparatus 27, and discharged to the outside of the apparatus to complete the print operation.

On the other hand, the transfer remaining toner that is not transferred and remains on the photosensitive member 18 is scraped by the cleaning blade 26 as a cleaning member for cleaning the surface of the photosensitive member, and accommodated in the waste toner accommodating container 25. The cleaned photosensitive member 18 repeatedly performs the action above.

The developing apparatus 22 includes the toner container 20 that accommodates the toner 20*a* as the one-component developer, and the developing roller 1 as a developer carrier located in an opening extended in the longitudinal direction within the toner container 20 and provided facing the photosensitive member 18. The developing apparatus 22 develops the electrostatic latent image on the photosensitive member 18 to visualize the electrostatic latent image.

EXAMPLES

Hereinafter, specific Examples and Comparative Examples according to the present invention will be described.

(Preparation of Mandrel 2)

The mandrel 2 was prepared by applying a primer (trade name, DY35-051; made by Dow Corning Toray Co., Ltd.) to a core metal made of SUS304 and having a diameter of 6 mm, and baking the primer.

(Production of Elastic Roller)

(Elastic Roller C-1)

The mandrel 2 prepared above was disposed in a metal mold, and an addition silicone rubber composition prepared by mixing materials shown Table 1 below was injected into a cavity formed within the metal mold.

TABLE 1

| | |
|---|---|
| Liquid silicone rubber material (trade name, SE6724A/B: made by Dow Corning Toray Co., Ltd.) | 100 parts by mass |
| Carbon black (trade name, TOKABLACK #4300: made by Tokai Carbon Co., Ltd.) | 15 parts by mass |
| Silica powder as heat resistance providing agent | 0.2 parts by mass |
| Platinum catalyst | 0.1 parts by mass |

Subsequently, the metal mold was heated, and the silicone rubber was vulcanized at a temperature of 150° C. for 15 minutes to be cured. The mandrel having a cured silicone rubber layer formed on the circumferential surface thereof was removed from the metal mold. Then, the core metal was further heated at a temperature of 180° C. for 1 hour to complete the curing reaction of the silicone rubber layer. Thus, Elastic Roller C-1 was produced in which the silicone rubber elastic layer having a diameter of 12 mm was formed on the outer periphery of the mandrel 2.

(Elastic Roller C-2)

Elastic Roller C-2 was produced in the same manner as in Elastic Roller C-1 except that carbon black was 10 parts by mass of TOKABLACK #4400 (trade name, made by Tokai Carbon Co., Ltd.).

(Elastic Roller C-3)

Elastic Roller C-3 was produced in the same manner as in Elastic Roller C-1 except that the amount of carbon black was 5 parts by mass.

(Elastic Roller C-4)

Elastic Roller C-4 was produced in the same manner as in Elastic Roller C-1 except that the amount of carbon black was 10 parts by mass, and the heat resistance-imparting agent was hydrophobized silica powder, and the amount thereof to be added was 5 parts by mass.

(Elastic Roller C-5)

Elastic Roller C-5 was produced in the same manner as in Elastic Roller C-2 except that the amount of carbon black was 12 parts by mass.

(Elastic Roller C-6)

Elastic Roller C-6 was produced in the same manner as in Elastic Roller C-1 except that the kinds and amounts of carbon black and silica powder were changed as shown in Table 2 below.

TABLE 2

| | |
|---|---|
| Carbon black (trade name, TOKABLACK #4400: made by Tokai Carbon Co., Ltd.) | 7 parts by mass |
| Hydrophobized silica powder as heat resistance providing agent | 5 parts by mass |

(Elastic Roller C-7)

The material that formed the elastic layer was replaced by the material shown in Table 3 below. Except that, Elastic Roller C-7 was produced in the same manner as in Elastic Roller C-1.

TABLE 3

| | |
|---|---|
| Dimethylvinylsiloxy-terminated dimethylpolysiloxane (weight average molecular weight of 100000) | 100.0 parts by mass |
| Dimethylvinylsiloxy-terminated methylmethoxysiloxane-dimethylsiloxane copolymer (weight average molecular weight of 8000, [dimethylsiloxane]/[methylmethoxysiloxane] = 50) | 5.0 parts by mass |
| Trimethylsiloxy-terminated methylhydrogensiloxane-dimethylsiloxane copolymer (weight average molecular weight of 1000) | 4.4 parts by mass (amount wherein mol number of SiH group/mol number of vinyl group = 2.0) |
| Carbon black (trade name, TOKABLACK #4300: made by Tokai Carbon Co., Ltd.) | 15 parts by mass |
| Platinum catalyst (concentration of Pt of 1%) | 0.1 parts by mass |

(Preparation of Surface Layer 4)

Hereinafter, a synthesis example for obtaining the polyurethane surface layer according to the present invention will be described.

<Measurement of Molecular Weight of Copolymer>

The apparatus and condition for measuring the number average molecular weight (Mn) and the weight average molecular weight (Mw) in the present Example are as follows:

Measurement apparatus: HLC-8120GPC (made by Tosoh Corporation)

Column: TSKgel SuperHZMM (made by Tosoh Corporation)×2

Solvent: THF (20 mmol/L of triethylamine was added)

Temperature: 40° C.

Flow rate of THF: 0.6 ml/min

A sample to be measured was 0.1% by mass of THF solution.

Further, using an RI (refractive index) detector as a detector, measurement was performed.

Using TSK standard polystyrenes A-1000, A-2500, A-5000, F-1, F-2, F-4, F-10, F-20, F-40, F-80, and F-128 (made by Tosoh Corporation) as a reference sample for creating a calibration curve, the calibration curve was created. From the retention time of the sample to be measured that was obtained from the calibration curve, the weight average molecular weight was determined.

(Synthesis of Polyether Diols A-1 to A-6)

A mixture of 144.2 g (2 mol) of dry tetrahydrofuran and 172.2 g (2 mol) of dry 3-methyltetrahydrofuran (molar mixing ratio of 50/50) was kept at a temperature of 10° C. in a reaction container. 13.1 g of 70% perchloric acid and 120 g of acetic anhydride were added to make the reaction for 3 hours. Next, the reaction mixture was poured into 600 g of a 20% sodium hydroxide aqueous solution, and refined. Further, the remaining water and solvent component were removed under reduced pressure to obtain 224 g of liquid Polyether Diol A-1. The number average molecular weight was 1000.

Polyether Diols A-2 to A-6 were obtained on the same condition except that the molar mixing ratio of dry tetrahydrofuran and dry 3-methyltetrahydrofuran and the reaction time were changed as shown in Table 4 below.

TABLE 4

| Polyether diol No. | Molar mixing ratio (dry tetrahydrofuran:dry 3-methyltetrahydrofuran) | Mn | Reaction time (hr) |
|---|---|---|---|
| A-1 | 50:50 | 1000 | 1.5 |
| A-2 | 50:50 | 2000 | 2.5 |
| A-3 | 50:50 | 3000 | 4.0 |
| A-4 | 50:50 | 4000 | 6.0 |
| A-5 | 90:10 | 2000 | 2.5 |
| A-6 | 80:20 | 2000 | 2.5 |

(Synthesis of Hydroxyl Group-Terminated Urethane Prepolymer A-7)

Under a nitrogen atmosphere, in the reaction container, 200.0 g of Polyether Diol A-1 was gradually dropped into 28.4 parts by mass of MDI (trade name: COSMONATE MDI, made by Mitsui Chemicals, Inc.) while the temperature within the reaction container was kept at 65° C. After dropping was completed, the reaction was made at a temperature of 75° C. for 3 hours. The obtained reaction product was cooled to room temperature (25° C.) to obtain 226 g of Hydroxyl Group-Terminated Urethane Prepolymer A-7. The number average molecular weight was 15000.

(Synthesis of Hydroxyl Group-Terminated Urethane Prepolymers A-8 and A-9)

Hydroxyl Group-Terminated Urethane Prepolymers A-8 and A-9 were obtained on the same condition except that the polyether diol and the reaction time used for the reaction were changed as shown in Table 5 below. The number average molecular weights of Prepolymers A-8 and A-9 are shown in Table 5.

TABLE 5

| Hydroxyl Group-Terminated Urethane Prepolymer No. | Polyether diol No. | Diisocyanate whose chain is extended | Mn after prepolymerization | Reaction time (hr) |
|---|---|---|---|---|
| A-7 | A-1 | MDI | 15000 | 3.0 |
| A-8 | A-2 | MDI | 10000 | 2.0 |
| A-9 | A-6 | MDI | 15000 | 3.0 |

(Synthesis of Isocyanate Group-Terminated Prepolymer B-1)

Under a nitrogen atmosphere, in the reaction container, 200.0 g of polypropylene glycol polyol (trade name: EXCENOL 1030; made by Asahi Glass Co., Ltd.) was gradually dropped into 69.6 parts by mass of tolylene diisocyanate (TDI) (trade name: COSMONATE 80; made by Mitsui Chemicals, Inc.) while the temperature within the reaction container was kept at 65° C. After dropping was completed, the reaction was made at a temperature of 65° C. for 2 hours. The obtained reaction mixture was cooled to room temperature to obtain 244 g of Isocyanate Group-Terminated Urethane Prepolymer B-1 having the content of the isocyanate group of 4.8%.

(Synthesis of Isocyanate Group-Terminated Prepolymer B-2)

Under a nitrogen atmosphere, in the reaction container, 200.0 g of polypropylene glycol polyol (trade name: EXCENOL 1030, made by Asahi Glass Co., Ltd.) was gradually dropped into 76.7 parts by mass of a polymeric MDI (trade name: Millionate MT, made by Nippon Polyurethane Industry Co., Ltd.) while temperature within the reaction container was kept at 65° C. After dropping was completed, the reaction was made at a temperature of 65° C. for 2 hours. The obtained reaction mixture was cooled to room temperature to obtain 229 g of Isocyanate Group-Terminated Urethane Prepolymer B-2 having the content of the isocyanate group of 4.7%.

(Synthesis of Isocyanate Group-Terminated Prepolymers B-3 and B-4)

Isocyanate Group-Terminated'Urethane Prepolymers B-3 and B-4 were obtained in the same manner as in Isocyanate Group-Terminated Prepolymer B-2 except that the polyether diol was Polyether Diols A-6 and A-3 in Table 4.

(Synthesis of Isocyanate Group-Terminated Prepolymer B-5)

Under a nitrogen atmosphere, in the reaction container, 200.0 g of Polyether Diol A-6 in Table 4 was gradually dropped into 46.4 parts by mass of CORONATE 2030 (trade name, made by Nippon Polyurethane Industry Co., Ltd.) while the temperature within the reaction container was kept at 65° C. After dropping was completed, the reaction was made at a temperature of 65° C. for, 2 hours. The obtained reaction mixture was cooled to room temperature to obtain 229 g of Isocyanate Group-Terminated Urethane Prepolymer B-5 having the content of the isocyanate group of 3.4%. The kind of polyether diol and isocyanate used for synthesis of Isocyanate Group-Terminated Prepolymers B-1 to B-5 and NCO % of the respective isocyanates are shown in Table 6.

TABLE 6

| Isocyanate Group-Terminated Prepolymer No. | Kind of polyether diol | Isocyanate Kind | Isocyanate NCO % |
|---|---|---|---|
| B-1 | Polypropylene glycol | TDI | 4.8 |
| B-2 | Polypropylene glycol | Polymeric MDI | 4.7 |
| B-3 | A-6 | Polymeric MDI | 4.0 |
| B-4 | A-3 | Polymeric MDI | 3.8 |
| B-5 | A-6 | TDI | 3.4 |

Example 1

Hereinafter, a method for producing a developing roller according to the present invention will be described.

As the raw material for the surface layer 4, the material shown in Table 7 below was added to the reaction container, and stirred and mixed.

TABLE 7

| Raw material | Parts by mass |
|---|---|
| Hydroxyl Group-Terminated Urethane Prepolymer A-9 | 100.0 |
| Isocyanate Group-Terminated Prepolymer B-4 | 6.7 |
| Carbon black (trade name: MA230, made by Mitsubishi Chemical Corporation) | 21.2 |

Next, methyl ethyl ketone (hereinafter, MEK) was added such that the ratio of the total solid content was 30% by mass, and the raw material was mixed by a sand mill. Further, the viscosity was adjusted at 10 to 13 cps by MEK to prepare a coating material for forming a surface layer. Elastic Roller C-2 produced above was dipped into the coating material for forming a surface layer to form coating of the coating material on the surface of the elastic layer of Elastic Roller C-2, and the coating was dried. Further, the coating was heat treated at a temperature of 150° C. for 1 hour to form a surface layer having a film thickness of approximately 20 μm on the outer periphery of the elastic layer. Thus, the developing roller according to Example 1 was produced.

The surface layer according to the present invention has the structure represented by the formula (1) and one or both structures selected from the structure represented by the formula (2) and the structure represented by the formula (3). This can be verified by an analysis using pyrolysis GC/MS, FT-IR or NMR, for example.

The surface layer obtained in the present Example was analyzed using a pyrolysis apparatus (trade name: Pyrofoil Sampler JPS-700, made by Japan Analytical Industry Co., Ltd.) and a GC/MS apparatus (trade name: Focus GC/ISQ, made by Thermo Fisher Scientific Inc.) wherein the pyrolysis temperature was 590° C. and helium was used as a carrier gas. As a result, it was found out from the obtained fragment peak that the surface layer has the structure represented by the formula (1) and one or both structures of the structure represented by the formula (2) and the structure represented by the formula (3).

The thus-obtained developing roller according to Example 1 was evaluated about the following items.

<Evaluation of Peel-Off of Surface Layer, and Measurement of Peeling Strength>

Evaluation of peel-off of the surface layer under a high temperature severe environment was performed by the following method. The developing roller according to Example 1 was left under an environment of a temperature of 40° C. and a relative humidity of 95% RH for 60 days. Subsequently, the developing roller was left for 3 hours under room temperature, and a cut of 10 mm×50 mm was formed in both ends of the developing roller. The developing roller was horizontally fixed, and the surface layer was vertically pulled from a corner of the cut at a rate of 10 mm/min to be forcibly peeled off. The load at this time was measured by a load cell. Each of the ends of the developing roller was measured three times, and the average value of n=6 was defined as peeling strength.

Next, the peeled surface was observed. Excluding a portion broken within the elastic layer or the surface layer (cohesive failure), peel-off of the surface layer was evaluated on the following criterion:

A: no peel-off is found at the interface between the surface layer and the elastic layer, B: peel-off of the interface between the surface layer and the elastic layer is found in the range of not more than 20% in the peeled surface, but the developing roller can be used without any problem, and C: peel-off of the interface between the surface layer and the elastic layer is found in most of or the entire peeled surface.

<Measurement of Surface Hardness>

The surface hardness of the developing roller was measured as follows: three points of a center, an upper portion, and a lower portion of the developing roller after the conductive resin layer was formed were measured under an environment of a temperature of 25° C. and a relative humidity of 50% RH by a micro rubber durometer (trade name: MD-1capa, made by Kobunshi Keiki Co., Ltd.) using a probe having a diameter of 0.16 mm. The average value of the measured values was used as the surface hardness.

<Evaluation of Filming>

The developing roller according to the present Example was mounted on a laser printer having a configuration as in FIG. 3 (trade name: LBP5300; made by Canon Inc.) to perform evaluation of filming. Namely, under an environment of a temperature of 15° C. and a relative humidity of 10% RH (hereinafter, L/L), using a black toner, an electrophotographic image of a 4-point letter of "E" of the alphabet at a coverage rate of 1% was continuously printed on an A4 size paper. Every time when 1000 sheets were printed, the surface of the developing roller was visually observed. The number of the image to be printed when adhering of the black toner onto the surface of the developing roller was found was defined as the number of sheets when the filming occurred.

<Measurement of Concentration of Adhering Toner>

The concentration of the adhering toner under a high temperature and highly humid environment was evaluated by the following method. The developing roller according to Example 1 was mounted on a yellow toner cartridge for the laser printer having a configuration as in FIG. 3 (trade name: LBP5300; made by Canon Inc.). The yellow toner cartridge was mounted on the laser printer. Using the laser printer, an operation to output a white solid image was performed to coat the surface of the developing roller with the yellow toner. The developing roller in such a state was extracted from the yellow toner cartridge. The developing roller was placed on a polytetrafluoroethylene flat plate, pressed against the flat plate at a load of 300 gf (a load of 150 gf in each of the ends of the mandrel), and left under an environment of a temperature of 40° C. and a relative humidity of 95% RH for 60 days. Next, the developing roller was released from the state where the developing roller was pressed against the flat plate, and left under an environment of a temperature of 25° C. and a relative humidity of 45% for 3 hours as it was. Subsequently, the surface of the developing roller was air blown. Then, the toner adhering onto the developing roller was peeled off using a sticky tape. The sticky tape to which the yellow toner was attached was placed on a normal paper, and the reflection density was measured using a reflection densitometer (trade name: TC-6DS/A, made by Tokyo'Denshoku Co., Ltd.). For comparison, a sticky tape to which no toner was attached was placed on a normal paper in the same manner, and the reflection density was measured. Based on the reflection density of the sticky tape to which no toner was attached, the amount of the reflectance to be reduced (%) was calculated. The measurement was performed at three points in total of a center and both ends of the developing roller. The arithmetic average value was defined as the concentration of the adhering toner in the developing roller to be evaluated.

<Measurement of Water Absorption Rate of Elastic Layer>

The water absorption rate of the elastic layer 3 was measured according to Japanese Industrial Standard (JIS) K7209 Method A using the elastic layer cut into a size of 2 mm×2 mm×25 mm as a test piece, and the average value of n=3 was defined as the water absorption rate of the elastic layer.

Examples 2 to 19

A coating material for forming a surface layer was prepared in the same manner as in Example 1 except that the material shown in Table 8 below was used as the raw material for the surface layer 4. The coating materials were respectively applied onto the elastic rollers shown in Table 8, dried, and heated in the same manner as in Example 1 to produce developing rollers according to Examples 2 to 19.

TABLE 8

| | Polyether diol or hydroxyl group-terminated urethane prepolymer | | Isocyanate | | Carbon black | Elastic roller |
|---|---|---|---|---|---|---|
| Example | No. | Parts by mass | No. | Parts by mass | Parts by mass | No. |
| 1 | A-9 | 100.0 | B-4 | 6.7 | 21.2 | C-2 |
| 2 | A-9 | 100.0 | B-5 | 7.9 | 21.5 | C-2 |
| 3 | A-8 | 100.0 | B-2 | 12.7 | 22.3 | C-2 |
| 4 | A-8 | 100.0 | B-2 | 12.7 | 22.3 | C-4 |
| 5 | A-8 | 100.0 | B-2 | 12.7 | 22.3 | C-5 |
| 6 | A-5 | 100.0 | B-3 | 125.8 | 43.1 | C-2 |
| 7 | A-6 | 100.0 | B-3 | 125.8 | 43.1 | C-2 |
| 8 | A-2 | 100.0 | B-3 | 125.8 | 43.1 | C-2 |
| 9 | A-6 | 100.0 | B-5 | 148.0 | 47.5 | C-2 |
| 10 | A-1 | 100.0 | p-MDI (*) | 64.9 | 22.3 | C-1 |
| 11 | A-1 | 100.0 | B-1 | 209.6 | 57.8 | C-1 |
| 12 | A-4 | 100.0 | B-2 | 51.6 | 29.3 | C-1 |
| 13 | A-7 | 100.0 | B-1 | 9.4 | 21.7 | C-1 |
| 14 | A-3 | 100.0 | B-1 | 69.3 | 32.5 | C-2 |
| 15 | A-3 | 100.0 | B-1 | 69.3 | 32.5 | C-3 |
| 16 | A-3 | 100.0 | B-1 | 69.3 | 32.5 | C-4 |
| 17 | A-3 | 100.0 | B-1 | 69.3 | 32.5 | C-5 |
| 18 | A-3 | 100.0 | B-1 | 69.3 | 32.5 | C-6 |
| 19 | A-3 | 100.0 | B-1 | 69.3 | 32.5 | C-7 |

(*) p-MDI: polymeric MDI (trade name: Millionate MR-200; made by Nippon Polyurethane Industry Co., Ltd.)

Comparative Example 1

As the material for the surface layer 4, the material shown in Table 9 below was placed in the reaction container, stirred, and mixed.

TABLE 9

| | |
|---|---|
| Poly(tetramethylene glycol) PTMG3000 (trade name, made by Sanyo Chemical Industries, Ltd.) | 100.0 parts by mass |
| Modified polyisocyanate B-2 | 82.5 parts by mass |
| Carbon black MA230 (trade name, made by Mitsubishi Chemical Corporation) | 34.9 parts by mass |

Hereinafter, a coating material for forming a surface layer according to Comparative Example 1 was prepared in the same manner as in the method for preparing a coating material for forming a surface layer according to Example 1. The coating material for forming a surface layer was applied onto the surface of the silicone rubber elastic layer of Elastic Roller C-1 in the same manner as in Example 1, and dried to form a surface layer. Thus, a developing roller according to Comparative Example 1 was produced.

Comparative Example 2

As the material for the surface layer 4, the material shown in Table 10 below was placed in the reaction container, stirred, and mixed.

TABLE 10

| | |
|---|---|
| Poly(tetramethylene glycol) (trade name: PTMG3000, made by Sanyo Chemical Industries, Ltd.) | 100.0 parts by mass |
| Polymeric MDI (trade name: Millionate MR-200, made by Nippon Polyurethane Industry Co., Ltd.) | 64.9 parts by mass |
| Carbon black (trade name: MA230, made by Mitsubishi Chemical Corporation) | 24.7 parts by mass |

Hereinafter, a coating material for forming a surface layer according to Comparative Example 2 was prepared in the same manner as in the method for preparing a coating material for forming a surface layer according to Example 1. The coating material for forming a surface layer was applied onto the surface of the silicone rubber elastic layer of Elastic Roller C-1 in the same manner as in Example 1, and dried to form a surface layer. Thus, a developing roller according to Comparative Example 2 was produced.

Comparative Example 3

As the material for the surface layer 4, the material shown in Table 11 below was placed in the reaction container, stirred, and mixed.

TABLE 11

| | |
|---|---|
| Polybutadiene polyol (trade name: Poly bd R-15HT, made by Idemitsu Kosan Co. Ltd.) | 100.0 parts by mass |
| Modified polyisocyanate B-2 | 229.7 parts by mass |
| Carbon black (trade name: MA230, made by Mitsubishi Chemical Corporation) | 61.5 parts by mass |

Hereinafter, a coating material for forming a surface layer according to Comparative Example 3 was prepared in the same manner as in the method for preparing a coating material for forming a surface layer according to Example 1. The coating material for forming a surface layer was applied onto the surface of the silicone rubber elastic layer of Elastic Roller C-1 in the same manner as in Example 1, and dried to form a surface layer. Thus, a developing roller according to Comparative Example 3 was produced.

The developing rollers according to Examples 2 to 19 and Comparative Examples 1 to 3 were evaluated in the same manner as in Example 1. The results are shown in Table 12 and Table 13.

TABLE 12

| Example | Peel-off of surface layer | Peeling strength (N) | Surface hardness (°) | The number of sheets when filming occurs (sheets) | Concentration of adhering toner (amount of reflectance to be reduced) (%) | Water absorption rate of elastic layer (%) |
|---|---|---|---|---|---|---|
| 1 | A | 2.7 | 35.1 | 20000 | 0.16 | 0.08 |
| 2 | A | 2.5 | 35.2 | 20000 | 0.66 | 0.08 |
| 3 | A | 2.3 | 35.9 | 18000 | 0.76 | 0.08 |
| 4 | A | 2.5 | 35.3 | 18000 | 0.68 | 0.02 |
| 5 | A | 2.0 | 35.5 | 18000 | 0.71 | 0.10 |
| 6 | A | 2.1 | 36.2 | 17000 | 0.86 | 0.08 |
| 7 | A | 2.0 | 35.9 | 19000 | 0.84 | 0.08 |
| 8 | A | 2.1 | 36.0 | 18000 | 0.95 | 0.08 |
| 9 | A | 2.2 | 35.8 | 18000 | 0.82 | 0.08 |
| 10 | B | 1.6 | 38.1 | 11000 | 1.54 | 0.22 |
| 11 | B | 1.5 | 37.3 | 12000 | 1.69 | 0.22 |
| 12 | B | 1.6 | 37.8 | 12000 | 1.81 | 0.22 |
| 13 | A | 2.1 | 35.7 | 18000 | 0.74 | 0.22 |
| 14 | B | 1.8 | 36.6 | 12000 | 1.75 | 0.08 |
| 15 | B | 1.8 | 36.5 | 12000 | 1.68 | 0.07 |
| 16 | B | 2.0 | 36.4 | 12000 | 1.88 | 0.02 |
| 17 | B | 1.6 | 36.9 | 12000 | 1.90 | 0.10 |
| 18 | B | 1.6 | 36.8 | 12000 | 1.94 | 0.09 |
| 19 | B | 1.6 | 36.5 | 12000 | 1.90 | 0.10 |

TABLE 13

| Comparative Example | Peel-off of surface layer | Peeling strength (N) | Surface hardness (°) | The number of sheets when filming occurs (sheets) | Concentration of adhering toner (amount of reflectance to be reduced) (%) | Water absorption rate of elastic layer (%) |
|---|---|---|---|---|---|---|
| 1 | C | 0.9 | 38.9 | 9000 | 2.24 | 0.22 |
| 2 | C | 1.2 | 39.5 | 7000 | 2.18 | 0.22 |
| 3 | C | 1.1 | 38.9 | 9000 | 2.46 | 0.22 |

In Examples 1 to 19, peel-off of the surface layer, increase in the hardness of the roller surface, and adhesion of the toner are all suppressed even after the developing roller is left under a high temperature severe environment for a long period of time.

Particularly, in Examples 1 to 9 and 13 in which the polyether diol having the structure represented by the formula (1) and the structure represented by the formula (2) or (3) is reacted with aromatic isocyanate to prepare a prepolymer, and further, the prepolymer is subjected to the curing reaction, peel-off of the surface layer and adhesion of the toner are suppressed at an extremely high level.

On the other hand, in the developing rollers in Comparative Examples 1 to 3 in which the urethane resin according to the present invention is not contained in the surface layer, adhesion of the toner or peel-off of the surface layer occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-292765, filed on Dec. 28, 2010, which is hereby incorporated by reference herein in its entirety.

What is claimed is:

1. A developing roller comprising a mandrel, an elastic layer, and a surface layer that covers a surface of the elastic layer, wherein the elastic layer comprises a cured material of an addition curable-type dimethyl silicone rubber, the surface layer comprises a urethane resin, and the urethane resin has, between two adjacent urethane linkage, a structure represented by the following formula (1), and at least one selected from the group consisting of a structure represented by the following formula (2) and a structure represented by the following formula (3):

formula (1)

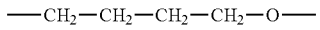

formula (2)

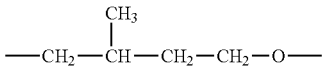

formula (3)

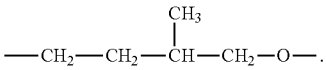

2. The developing roller according to claim 1, wherein a water absorption rate of the elastic layer measured according to Japanese Industrial Standard (JIS) K7209 Method A, is not less than 0.02% and not more than 0.10%.

3. An electrophotographic apparatus comprising the developing roller according to claim 1, and an electrophotographic photosensitive member disposed abutting on the developing roller.

4. A process cartridge comprising the developing roller according to claim 1, and an electrophotographic photosensitive member disposed abutting on the developing roller, and detachably attached to a main body of an electrophotographic apparatus.

* * * * *